US009898893B2

(12) United States Patent
Tanner

(10) Patent No.: US 9,898,893 B2
(45) Date of Patent: Feb. 20, 2018

(54) GAMING SYSTEM WITH SPAWNING WILD SYMBOLS

(71) Applicant: IGT CANADA SOLUTIONS ULC, Moncton (CA)

(72) Inventor: Lee Andrew Tanner, Irishtown (CA)

(73) Assignee: IGT CANADA SOLUTIONS ULC, Moncton (CA)

( * ) Notice: Subject to any disclaimer, the term of this patent is extended or adjusted under 35 U.S.C. 154(b) by 173 days.

(21) Appl. No.: 14/698,021

(22) Filed: Apr. 28, 2015

(65) Prior Publication Data

US 2016/0321859 A1 Nov. 3, 2016

(51) Int. Cl.
*G07F 17/32* (2006.01)

(52) U.S. Cl.
CPC ..... *G07F 17/3267* (2013.01)

(58) Field of Classification Search
CPC ..... G07F 17/3267
See application file for complete search history.

(56) References Cited

U.S. PATENT DOCUMENTS

2009/0131145 A1* 5/2009 Aoki ..... G07F 17/3211 463/20
2010/0087243 A1* 4/2010 Saito ..... G07F 17/34 463/20
2011/0059788 A1* 3/2011 Itagaki ..... G07F 17/3244 463/20
2013/0324217 A1* 12/2013 Gilbertson ..... G07F 17/34 463/20

* cited by examiner

*Primary Examiner* — William H McCulloch, Jr.
*Assistant Examiner* — Yingchuan Zhang
(74) *Attorney, Agent, or Firm* — Sage Patent Group

(57) ABSTRACT

A gaming system includes an input mechanism for initiating a game and one or more displays providing a plurality of reels. The gaming system also includes a controller coupled to the one or more displays and the input mechanism. The controller is configured to: detect a win involving a combination of the symbol instances across two or more of the reels; determine that at least one of the symbol instances involved in the win is a wild symbol, the wild symbol able to assume the identity of at least one other symbol when detecting the win; and in response to determining that at least one of the symbol instances involved in the win is a wild symbol, updating at least one of the other of the symbol instances involved in the win to include a wild symbol for at least the next iteration of the game.

20 Claims, 7 Drawing Sheets

GAMING SYSTEM WITH SPAWNING WILD SYMBOLS

TECHNICAL FIELD

The present disclosure relates generally to electronic gaming systems, such as casino gaming terminals. More specifically, the present disclosure relates to methods and systems for providing a gaming system having reels having symbols that change.

BACKGROUND

Gaming terminals and systems, such as casino-based gaming terminals, often include a number of reels which may be spun to initiate a game. For example, on a slot machine, each reel has a plurality of symbols and each reel moves independently of the other reels. When the reels stop spinning, the machine determines whether the player has won the game based on the arrangement of symbols on the reels. More particularly, the arrangement of symbols at particular locations on the reels may be compared to a paytable to determine whether the player has won.

Traditionally, slot machines have used mechanical reels which have symbols permanently applied at various locations.

BRIEF DESCRIPTION OF THE DRAWINGS

Reference will now be made, by way of example, to the accompanying drawings which show an embodiment of the present application, and in which.

Similar reference numerals are used in different figures to denote similar components.

DETAILED DESCRIPTION OF EXAMPLE EMBODIMENTS

There is described a gaming system providing a game. The gaming system includes an input mechanism for initiating the game. The gaming system also includes one or more displays providing a plurality of reels. The plurality of reels are provided in a first gaming zone of the one or more displays. The first gaming zone includes a matrix of symbol locations which are updated to provide results of the game by showing symbol instances. The gaming system also includes a controller coupled to the one or more displays and the input mechanism. The controller is configured to: detect a win involving a combination of the symbol instances across two or more of the reels; determine that at least one of the symbol instances involved in the win is a wild symbol, the wild symbol able to assume the identity of at least one other symbol when detecting the win; and in response to determining that at least one of the symbol instances involved in the win is a wild symbol, updating at least one of the other of the symbol instances involved in the win to include a wild symbol for at least the next iteration of the game.

In another embodiment, there is described a method performed by a gaming system. The method includes: detecting a win involving a combination of the symbol instances across two or more of reels; determining that at least one of the symbol instances involved in the win is a wild symbol, the wild symbol able to assume the identity of at least one other symbol when detecting the win; and in response to determining that at least one of the symbol instances involved in the win is a wild symbol, updating at least one of the other of the symbol instances involved in the win to include a wild symbol for at least the next iteration of the game.

In yet a further aspect, the present application describes non-transitory computer-readable media storing computer-executable program instructions which, when executed, configured a processor to perform the described methods.

Other aspects and features of the present application will be understood by those of ordinary skill in the art from a review of the following description of examples in conjunction with the accompanying figures.

Other aspects and features of the present application will become apparent to those ordinarily skilled in the art upon review of the following description of specific embodiments of the application in conjunction with the accompanying figures.

Figure 1:
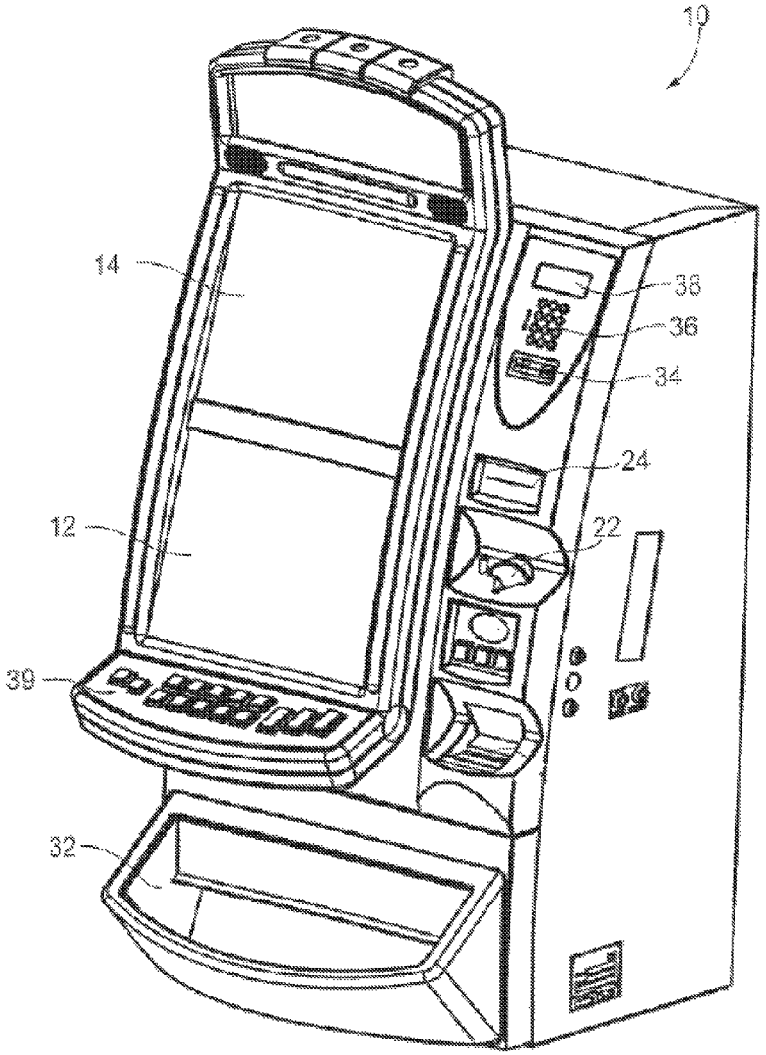
FIG. 1 shows an example electronic gaming system (EGM) in accordance with example embodiments of the present disclosure.

An example gaming system, which will be referred to as an electronic gaming machine (EGM) 10, is illustrated in FIG. 1. The example EGM 10 of FIG. 1 is shown in perspective view. The example EGM 10 is configured to provide a dynamic gaming mode in which one or more symbols provided on a reel may be updated.

The EGM 10 includes a primary display 12 which may be of a variety of different types including, for example, a thin film transistor (TFT) display, a liquid crystal display (LCD), a cathode ray tube (CRT), a light emitting diode (LED) display, an organic light emitting diode (OLED) display, or a display of another type. The display 12 is, in some embodiments, a three-dimensional (3D) display which may be operated in a 3D mode. That is, the display is configured to provide 3D viewing of at least a portion of a game. For example, the display 12, in conjunction with other components of the EGM 10, may provide stereoscopic 3D viewing of a portion of the game.

The EGM 10 of FIG. 1 also includes a second display 14. The second display 14 provides game data or other information in addition to the display 12. The second display 14 may provide static information, such as an advertisement for the game, the rules of the game, pay tables, pay lines, or other information, or may even display the main game or a bonus game along with the display 12. The second display 14 may utilize any of the display technologies noted above (e.g., LED, OLED, CRT, etc.) and may also be an auto stereoscopic display. In such embodiments, the second display 14 may be equipped with a secondary camera (which may be a stereo camera) for tracking the location of a user's eyes relative to the second display 14. In some embodiments, the second display may not be an electronic display; instead, it may be a display glass for conveying information about the game.

The EGM 10 is equipped with one or more input mechanisms. For example, in some embodiments, one or both of the displays 12 and 14 may be a touchscreen which includes a touchscreen layer, such as a touchscreen overlay. The touchscreen layer is touch-sensitive such that an electrical signal is produced in response to a touch. In an embodiment, the touchscreen is a capacitive touchscreen which includes a transparent grid of conductors. Touching the screen causes a change in the capacitance between conductors, which allows the location of the touch to be determined. The touchscreen may be configured for multi-touch.

Other input mechanisms may be provided instead of or in addition to the touchscreen. For example, a keypad 36 may accept player input, such as a personal identification number (PIN) or any other player information. A display 38 above keypad 36 displays a menu for instructions and other information and provides visual feedback of the keys pressed. The keypad 36 may be an input device such as a touchscreen, or dynamic digital button panel, in accordance with some embodiments.

Control buttons 39 may also act as an input mechanism and be included in the EGM. The control buttons 39 may include buttons for inputting various input commonly associated with a game provided by the EGM 10. For example, the control buttons 39 may include a bet button, a repeat bet button, a spin reels (or play) button, a maximum bet button, a cash-out button, a display pay lines button, a display payout tables button, select icon buttons, or other buttons. In some embodiments, one or more of the control buttons may be virtual buttons which are provided by a touchscreen.

The EGM 10 may also include currency, credit or token handling mechanisms for receiving currency, credits or tokens required for game play or for dispensing currency, credits or tokens based on the outcome of the game play. A coin slot 22 may accept coins or tokens in one or more denominations to generate credits within EGM 10 for playing games. An input slot 24 for an optical reader and printer receives machine readable printed tickets and outputs printed tickets for use in cashless gaming.

A coin tray 32 may receive coins or tokens from a hopper upon a win or upon the player cashing out. However, the EGM 10 may be a gaming terminal that does not pay in cash but only issues a printed ticket which is not legal tender. Rather, the printed ticket may be converted to legal tender elsewhere.

In some embodiments, a card reader interface 34, such as a card reader slot, may allow the EGM 10 to interact with a stored value card, identification card, or a card of another type. A stored value card is a card which stores a balance of credits, currency or tokens associated with that card. An identification card is a card that identifies a user. In some cases, the functions of the stored value card and identification card may be provided on a common card. However, in other embodiments, these functions may not be provided on the same card. For example, in some embodiments, an identification card may be used which allows the EGM 10 to identify an account associated with a user. The identification card uniquely identifies the user and this identifying information may be used, for example, to track the amount of play associated with the user (e.g., in order to offer the user promotions when their play reaches certain levels). The identification card may be referred to as a player tracking card. In some embodiments, an identification card may be inserted to allow the EGM 10 to access an account balance associated with the user's account. The account balance may be maintained at a host system or other remote server accessible to the EGM 10 and the EGM 10 may adjust the balance based on game play on the EGM 10. In embodiments in which a stored value card is used, a balance may be stored on the card itself and the balance may be adjusted to include additional credits when a winning outcome results from game play.

The stored value card and/or identification card may include a memory and a communication interface which allows the EGM 10 to access the memory of the stored value card. The card may take various forms including, for example, a smart card, a magnetic strip card (in which case the memory and the communication interface may both be provided by a magnetic strip), a card with a bar code printed thereon, or another type of card conveying machine readable information. In some embodiments, the card may not be in the shape of a card. Instead, the card may be provided in another form factor. For example, in some embodiments, the card may be a virtual card residing on a mobile device such as a smartphone. The mobile device may, for example, be configured to communicate with the EGM 10 via a near field communication (NFC) subsystem.

The nature of the card reader interface 34 will depend on the nature of the cards which it is intended to interact with. The card reader interface may, for example, be configured to read a magnetic code on the stored value card, interact with pins or pads associated with the card (e.g., if the card is a smart card), read a bar code or other visible indicia printed on the card (in which case the card reader interface 34 may be an optical reader), or interact with the card wirelessly (e.g., if it is NFC enabled). In some embodiments, the card is inserted into the card reader interface 34 in order to trigger the reading of the card. In other embodiments, such as in the case of NFC enabled cards, the reading of the card may be performed without requiring insertion of the card into the card reader interface 34.

Figure 2:
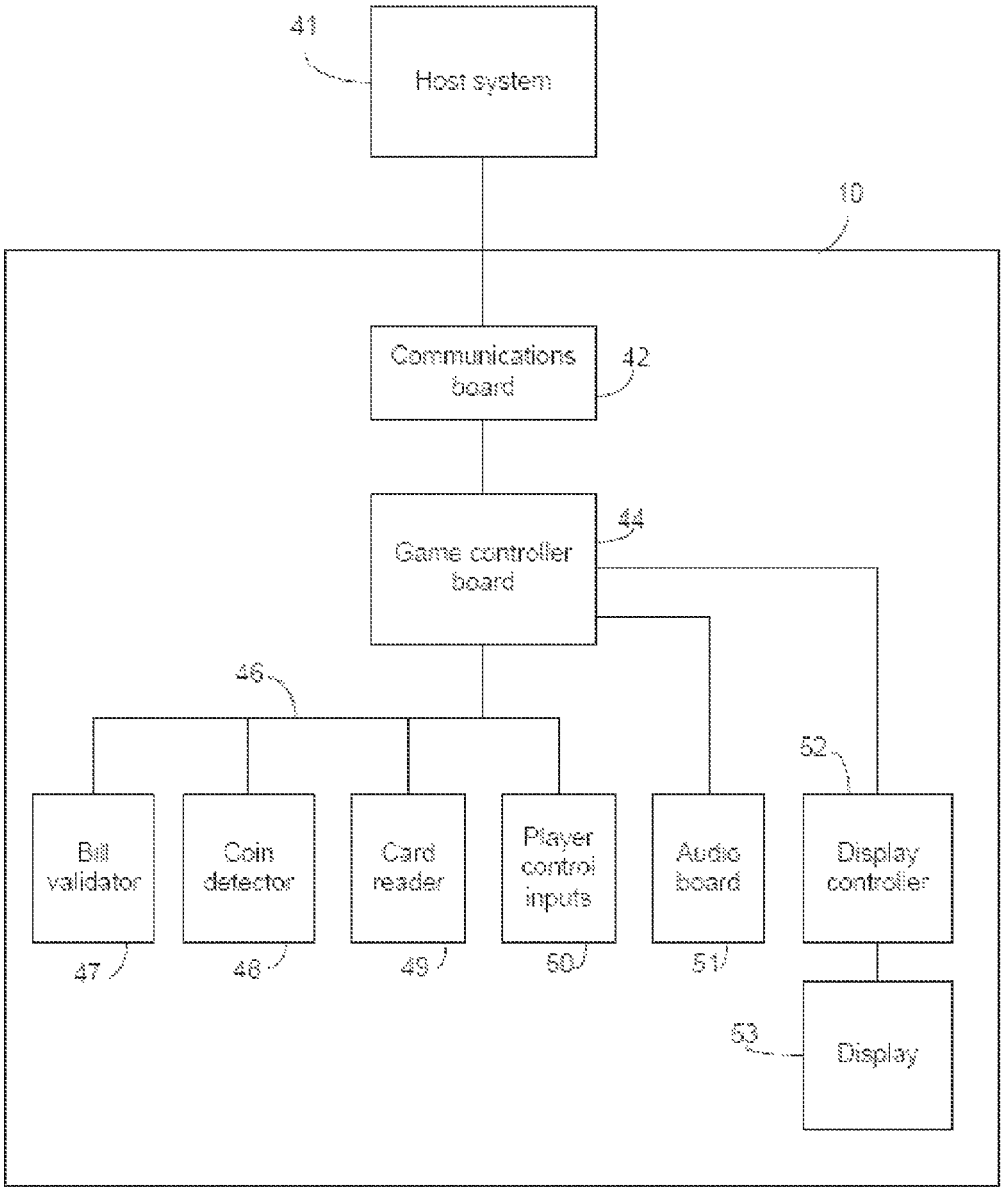
FIG. 2 illustrates a block diagram of an EGM in accordance with an embodiment of the present disclosure.

Reference will now be made to FIG. 2 which illustrates a block diagram of an EGM 10, which may be an EGM of the type described above with reference to FIG. 1.

The example EGM 10 is linked to a casino's host system 41. The host system 41 may provide the EGM 10 with instructions for carrying out game routines. The host system 41 may also manage a player account and may adjust a balance associated with the player account based on game play at the EGM 10.

The EGM 10 includes a communications board 42 which may contain conventional circuitry for coupling the EGM to a local area network (LAN) or another type of network using any suitable protocol, such as the Game to System (G2S) standard protocol. The communications board 42 may allow the EGM 10 to communicate with the host system 41 to enable software download from the host system 41, remote configuration of the EGM 10, remote software verification, and/or other features. The G2S protocol document is available from the Gaming Standards Association and this document is incorporated herein by reference.

The communications board 42 transmits and receives data using a wireless transmitter, or it may be directly connected to a network running throughout the casino floor. The communications board 42 establishes a communication link with a master controller and buffers data between the network and a game controller board 44. The communications board 42 may also communicate with a network server, such as the host system 41, for exchanging information to carry out embodiments described herein.

The communications board 42 is coupled to a game controller board 44. The game controller board 44 contains memory and a processor for carrying out programs stored in the memory and for providing the information requested by the network. The game controller board 44 primarily carries out the game routines.

Peripheral devices/boards communicate with the game controller board 44 via a bus 46 using, for example, an RS-232 interface. Such peripherals may include a bill validator 47, a coin detector 48, a card reader interface such as a smart card reader or other type of card reader 49, and player control inputs 50 (such as buttons or a touch screen). Other peripherals may include one or more cameras or other locating sensors 58 used for eye, hand, finger, and/or head tracking of a user to provide the auto stereoscopic functions and contactless tactile feedback function described herein.

The game controller board 44 may also control one or more devices that produce the game output including audio and video output associated with a particular game that is presented to the user. For example an audio board 51 may convert coded signals into analog signals for driving speakers. A display controller 52, which typically requires a high data transfer rate, may convert coded signals to pixel signals for the display 53. The display controller 52 and audio board 51 may be directly connected to parallel ports on the game controller board 44. The electronics on the various boards may be combined onto a single board.

The EGM 10 includes one or more processors which may be provided, for example, in the game controller board 44 and/or the display controller 52. It will be appreciated that a single "main processor", which may be provided in the game controller board, for example, may perform all of the processing functions described herein or the processing functions may be distributed.

Figure 3:
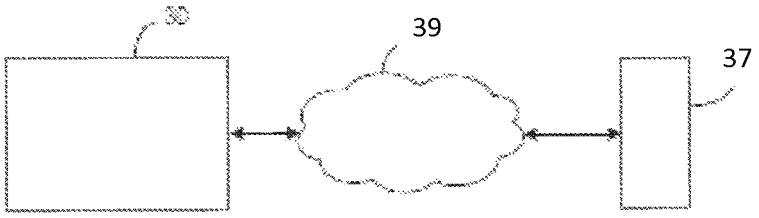
FIG. 3 is an example online implementation of a computer system configured for gaming.

The techniques described herein may also be used with other electronic devices, apart from the EGM 10. For example, in some embodiments, the techniques described herein may be used in a computing device 30. Referring now to FIG. 3, an example online implementation of a computer system and online gaming device is illustrated. For example, a server computer 37 may be configured to enable online gaming in accordance with embodiments described herein. Accordingly, the server computer 37 and/or the computing device 30 may perform one or more functions of the EGM 10 described herein.

One or more users may use a computing device 30 that is configured to connect to the Internet 39 (or other network), and via the Internet 39 to the server computer 37 in order to access the functionality described in this disclosure. The server computer 37 may include a movement recognition engine that may be used to process and interpret collected player movement data, to transform the data into data defining manipulations of game components or view changes.

The computing device 30 may be configured with hardware and software to interact with an EGM 10 or server computer 37 via the internet 39 (or other network) to implement gaming functionality and render three dimensional enhancements, as described herein. For simplicity only one computing device 30 is shown but system may include one or more computing devices 30 operable by users to access remote network resources. The computing device 30 may be implemented using one or more processors and one or more data storage devices configured with database(s) or file system(s), or using multiple devices or groups of storage devices distributed over a wide geographic area and connected via a network (which may be referred to as "cloud computing").

The computing device 30 may reside on any networked computing device, such as a personal computer, workstation, server, portable computer, mobile device, personal digital assistant, laptop, tablet, smart phone, WAP phone, an interactive television, video display terminals, gaming consoles, electronic reading device, and portable electronic devices or a combination of these.

The computing device 30 may include any type of processor, such as, for example, any type of general-purpose microprocessor or microcontroller, a digital signal processing (DSP) processor, an integrated circuit, a field programmable gate array (FPGA), a reconfigurable processor, a programmable read-only memory (PROM), or any combination thereof. The computing device 30 may include any type of computer memory that is located either internally or externally such as, for example, random-access memory (RAM), read-only memory (ROM), compact disc read-only memory (CDROM), electro-optical memory, magneto-optical memory, erasable programmable read-only memory (EPROM), and electrically-erasable programmable read-only memory (EEPROM), Ferroelectric RAM (FRAM) or the like.

The computing device 30 may include one or more input mechanisms, such as a keyboard, mouse, camera, touch screen and a microphone, and may also include one or more output devices such as a display screen (with three dimensional capabilities) and a speaker. The computing device 30 has a network interface in order to communicate with other components, to access and connect to network resources, to serve an application and other applications, and perform other computing applications by connecting to a network (or multiple networks) capable of carrying data including the Internet, Ethernet, plain old telephone service (POTS) line, public switch telephone network (PSTN), integrated services digital network (ISDN), digital subscriber line (DSL), coaxial cable, fiber optics, satellite, mobile, wireless (e.g. Wi-Fi, WiMAX), SS7 signaling network, fixed line, local area network, wide area network, and others, including any combination of these. The computing device 30 is operable to register and authenticate users (using a login, unique identifier, and password for example) prior to providing access to applications, a local network, network resources, other networks and network security devices. The computing device 30 may serve one user or multiple users.

Figure 4:
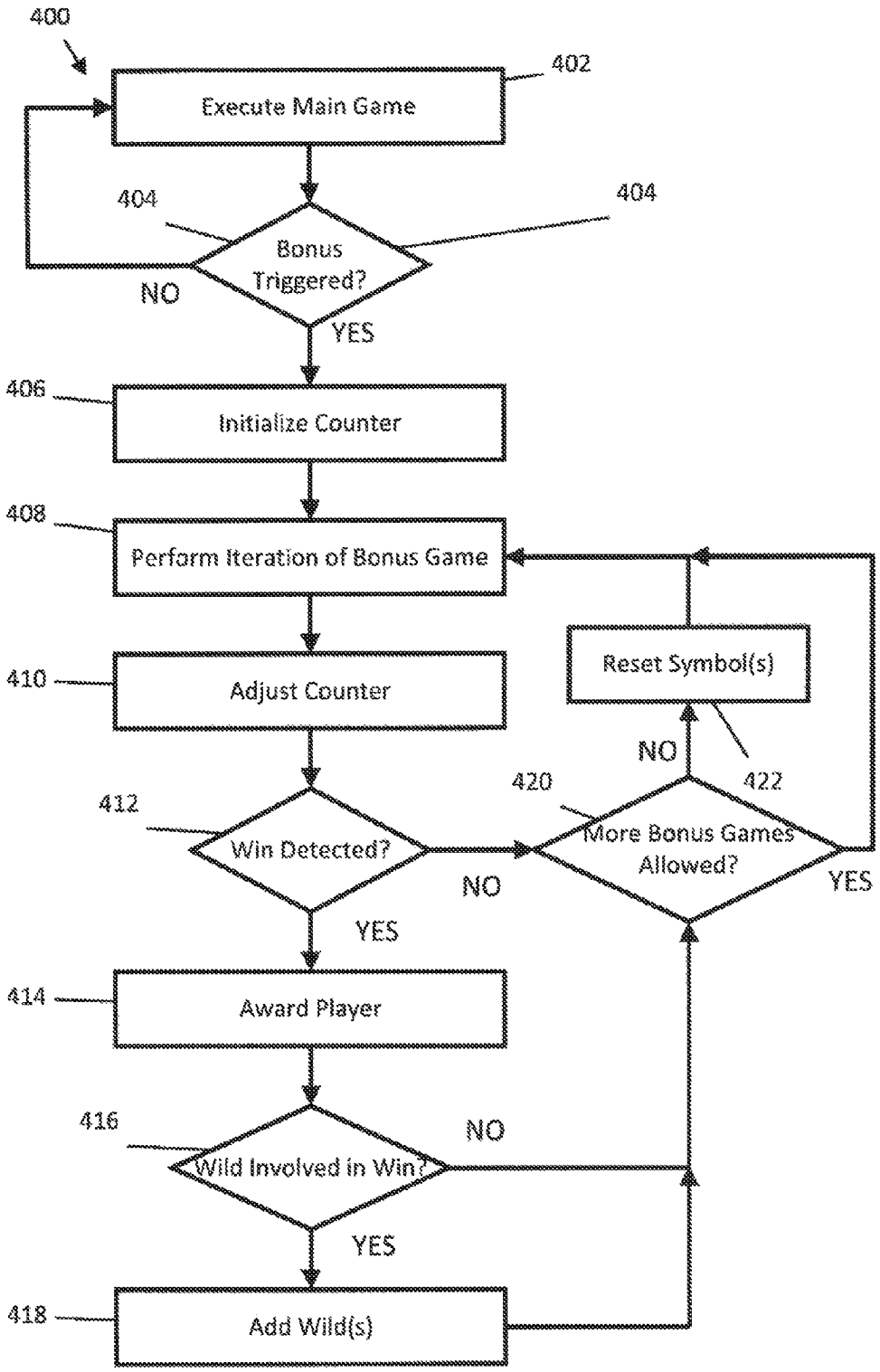
FIG. 4 is an example flowchart of a method for providing dynamic symbols on a gaming system in accordance with example embodiments of the present disclosure.

Referring now to FIG. 4, an example method 400 will now be described. The method 400 may be performed by an EGM 10 configured for providing a game to a player, or a computing device 30. More particularly, the EGM 10 or the computing device may include one or more controllers, such as one or more processors, which may be configured to perform the method 400 or parts thereof. In at least some embodiments, the processor(s) are coupled with memory containing computer-executable instructions. These computer-executable instructions are executed by the associated processor(s) and configure the processor(s) to perform the method 400. The EGM 10 and/or computing device that is configured to perform the method 400, or a portion thereof, includes hardware components discussed herein that are necessary for performance of the method 400. The processor(s) are configured to perform the method 400. In other embodiments, a processor associated with a host system may perform at least some of the functions of the method 400.

At operation 402, the EGM 10 provides a main game to a player. The main game may, for example, be a casino-based game in which the EGM 10 receives a wager from the player, executes a game session (referred to herein as an "iteration" of the game), and determines whether the player has won or lost the game session. Where the player has won the game session, a reward may be provided to the player in the form of cash, coins, tokens, credits, etc.

Figure 5:
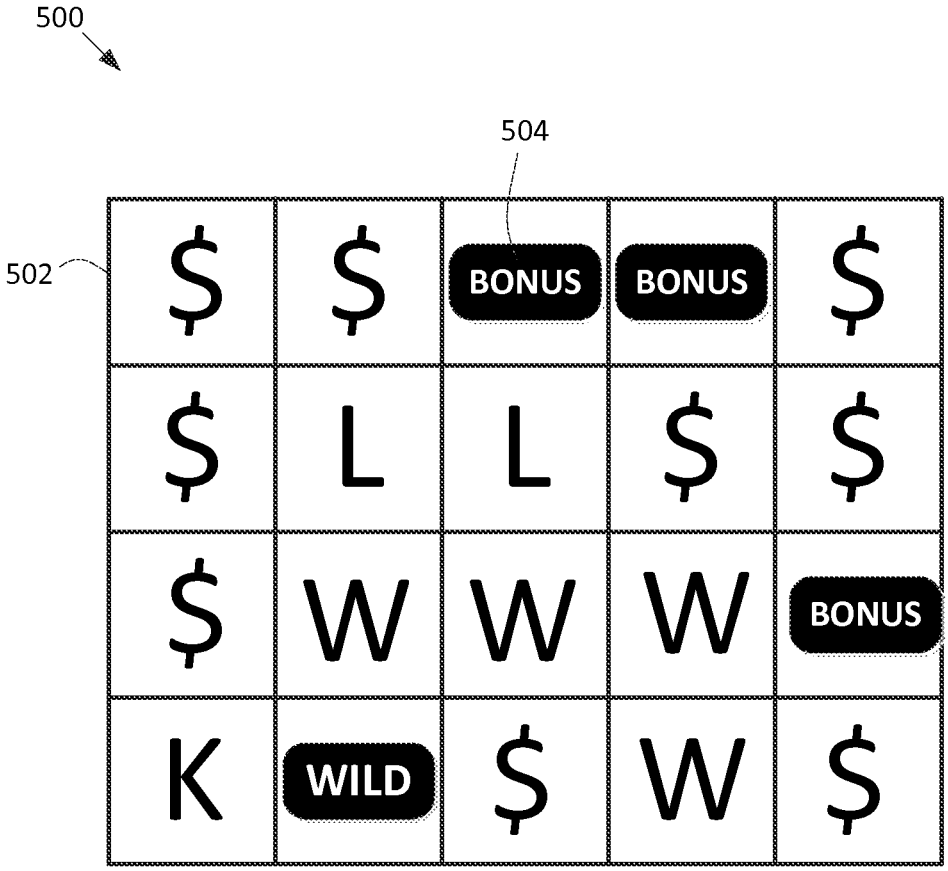
FIG. 5 is an example display screen representing a first gaming zone before a wild symbol has been spawned.

Referring briefly to FIG. 5 which illustrates an example display screen 500, the main game may, in some embodiments, be a slot-machine style game in which a plurality of reels are provided in a first gaming zone 502 of one or more displays. The first gaming zone comprises a matrix of symbol locations which are updated to provide results of the game by showing symbol instances. That is, the gaming zone 502 provides virtual reels and the gaming zone is updated during gameplay to simulate the spinning and stopping of the virtual reels.

In the example of FIG. 5, the first gaming zone is a four by five matrix which has four rows and five columns of symbol instances. The gaming zone may, however, have a different number or row and/or columns than the illustration in FIG. 5 in some embodiments.

In the example of FIG. 5, lines have been included to demarcate symbol locations. However, these lines may not be included in all embodiments, or, in some embodiments, vertical lines may be included to demarcate various reels (e.g., each column may be a virtual reel) but horizontal lines may not be included to demarcate the rows.

The main game includes at least one wild symbol which is, after at least some iterations of the main game, displayed in at least one of the symbol locations of the first gaming zone.

One or more paylines are defined for the gaming zone. The payline is a line that crosses through one symbol on each of the virtual reels. Wins are determined based on the symbols located along the payline(s) following an iteration of the game. The paylines may, in various embodiments, include horizontal, vertical, oblique, triangular, trapezoidal, and/or zigzag, paylines. Other paylines may be used apart from those noted above.

The main game provided at operation 402 may permit a player to place a wager, initiate an instance of the main game, and selectively provide an award to the player based on the outcome of the game. For example, if an iteration of the game results in a combination that corresponds to a winning combination defined in a pay table that is stored in memory associated with the EGM 10, then the player may receive an award.

The main game may permit a bonus game to be triggered based on the outcome of one or more iterations of the main game. For example, in an embodiment, the main game includes a plurality of bonus symbols 504 which may be used in determining whether to trigger a bonus. For example, in an embodiment, the main game includes bonus symbols 504 and at least a portion of these bonus symbols are, after at least some iterations of the main game, displayed in at least one of the symbol locations of the first gaming zone 502.

In at least some embodiments, a bonus game may be triggered based on occurrence of the bonus symbols 504 following an iteration of the main game. For example, in at least some embodiments, the bonus game may be triggered when at least a predetermined number of bonus symbols are represented in the first gaming zone following an iteration of the game. For example, in one embodiment, when at least three bonus symbols are detected in the first gaming zone 502 following an iteration of the main game, the bonus game will be triggered.

In some embodiments, the bonus game may be triggered if the predetermined number of bonus symbols (e.g. three) are located in any symbol locations in the first gaming zone 502; that is, the specific locations of the bonus symbols 504 do not matter, scattered bonus symbols are sufficient to trigger the bonus game. In other embodiments, the locations of the bonus symbols will also be considered when determining whether to award a bonus game. For example, in an embodiment, at least the predetermined number of bonus symbols must be consecutively located across a payline in order to trigger the bonus game. For example, in an embodiment, three bonus symbols consecutively located in a horizontal line trigger the bonus game.

Referring again to FIG. 4, at 404, at operation 404, the EGM 10 determines whether the bonus game has been triggered. If the bonus game has been triggered, then at operation 406 the EGM 10 may initialize one or more variables and/or counters to track the number of iterations of the bonus game that the player is permitted to play. The player may be permitted to play a specific number of iterations of the bonus game and, in at least some embodiments, the number of iterations of the bonus game may be dependent upon a total iteration count. The total iteration count may, in at least some embodiments, be initialized at operation 406 based on the number of bonus symbols that were included in the first gaming zone when the bonus game was triggered. That is, a bonus portion of the game provided by the EGM may permit a player to play a specific number of iterations of a bonus game and the specific number of iterations of the bonus game that is provided to the player may be determined in accordance with one or more predetermined rules which are based on outcome of game play in the main game. The player may be permitted to play more iterations of the game if a higher number of bonus symbols were displayed in the first gaming zone than if a lower number of bonus symbols were displayed in the first gaming zone. For example, if three bonus symbols triggered the bonus game, then the player may be awarded ten bonus game iterations while if four bonus symbols triggered the bonus game, then the player may be awarded fifteen bonus game iterations, and if five bonus symbols triggered the bonus game, then the player may be awarded twenty bonus game iterations.

As will be described below, the EGM 10 may count the number of iterations of the bonus game that have been played after the bonus game has been triggered in order to determine when to revert back to the main game. A counter may therefore be initialized at operation 406. The counter is in some embodiments, initialized to zero and is incremented with each iteration of the bonus game until it is determined by the EGM that the player has played all available bonus game iterations (e.g., when counter=total iteration count), at which point the bonus game may stop and play may resume with the main game. Other techniques for tracking the number of iterations of the bonus game played may also be used. For example, the total iteration count may be initialized to represent the total number of bonus games awarded to the player and then decremented after each bonus game iteration until hitting zero, when the bonus game is terminated and play resumes with the main game.

During the first iteration of the bonus game after the bonus game is triggered, the set of symbol instances which are represented on the virtual reels includes at least one wild symbol. This wild symbol that was initiated before a first iteration of a bonus game and which was included in the first iteration of the bonus game may be referred to as an original wild symbol.

At operation 408, an iteration of the bonus game is performed. The iteration of the bonus game occurs in response to user input received at an input mechanism of the EGM. For example, a lever or button may be depressed to initiate an iteration of the bonus game.

During the iteration of the bonus game, the first gaming zone 502 is updated to display a new set of symbol instances in the matrix of symbol locations provided in the first gaming zone. The symbol instances that are to be displayed may be selected based on an output of a random number generator, for example. In at least some embodiments, during an iteration of a bonus game, an animation of spinning reels is displayed on the display. The reels eventually slow and come to a stop so that the new set of symbol instances are displayed.

At 410, a counter which tracks the number of iterations of the bonus game is adjusted to reflect the fact that the last iteration of the bonus game has consumed one of the available bonus game iteration plays that have been granted to the user.

During or after the iteration of the bonus game, an outcome of the iteration of the bonus game may be determined (at operation 412). That is, the EGM determines whether the player has won or lost the game iteration. A win involves a combination of symbols instances across two or more of the reels. As with the main game, the determination of a win for the bonus game may be made by comparing symbol instances along a payline to winning symbol combinations in a paytable stored in memory. The paytable for the bonus game is, in at least some embodiments, a different paytable than for the main game.

If the outcome of the game is a win, then at operation 414 the player is awarded. More particularly, the EGM 10 may provide a reward in the form of cash, credit, virtual currency such as points or tokens, additional bonus game iteration, or another suitable reward.

Additionally, when a win is detected, at operation 416, the EGM 10 determines whether at least one of the symbol instances involved in the win is a wild symbol 510. A wild symbol is a symbol that is able to assume the identity of at least one other symbol when detecting a win. For example, in some embodiments, a wild symbol may assume the identity of any other symbol when determining whether a win has occurred. For example, if a payline has two symbols that match a three symbol winning combination defined in the paytable and if a third symbol in the payline is a wild symbol, then a win may be determined to occur since the wild symbol can assume the identity of the other of the symbols in the three symbol winning combination defined in the paytable.

Figure 6:
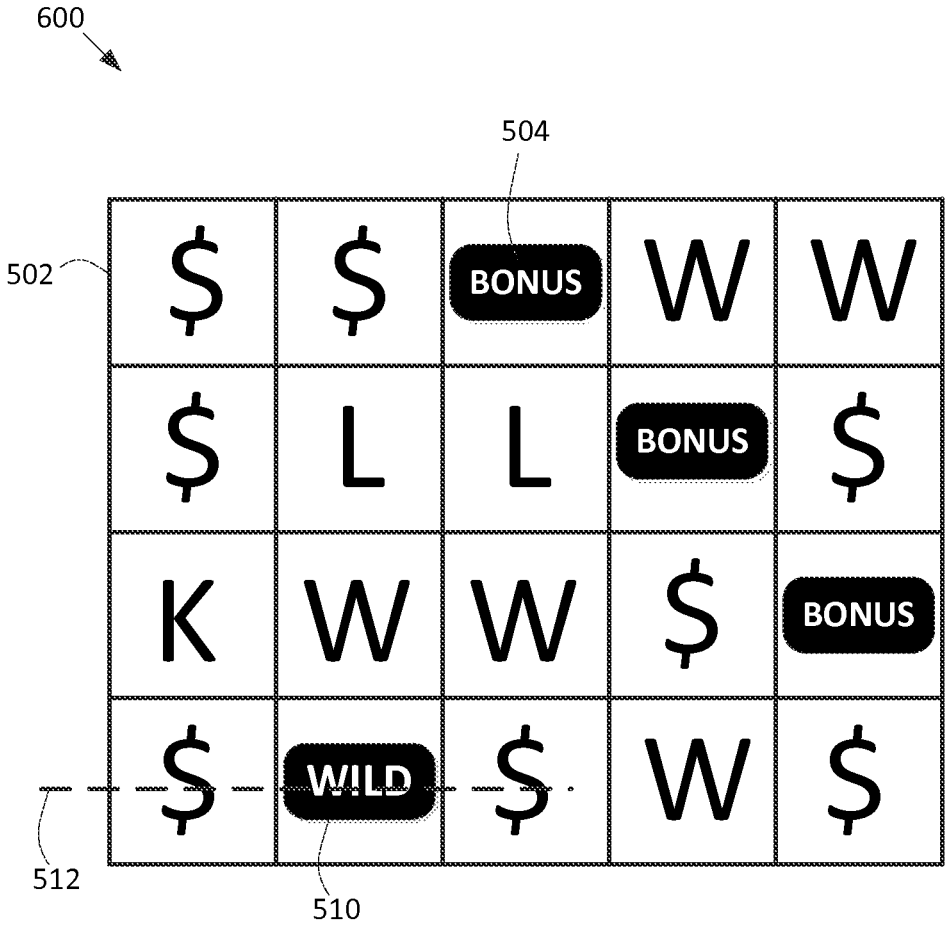
FIG. 6 is an example display screen representing the first gaming zone after a wild symbol has been spawned.

Referring now to FIG. 6, an example display screen is illustrated. The example display illustrates a possible display screen following an iteration of the bonus game. The virtual reels displayed in FIG. 5 may be spun and a wild symbol 510 may appear in the first display zone 502. The wild symbol is able to assume the identity of another symbol. Thus, a combination of $, WILD, $ across a payline 512 may be determined to be a winning combination if, for example, $, $, $ is indicated as a winning combination in the paytable. In this example, the wild symbol 510 assumes the identity of the $ symbol.

Referring again to FIG. 4, in response to determining that at least one of the symbol instances involved in the win is a wild symbol, at operation 418, at least one of the other of the symbol instances involved in the win is updated to include the wild symbol for at least the next iteration of the game. That is, the wild symbol 510 involved in the win may spawn additional wilds at the other symbol locations involved in the win. For example, in an embodiment all non-wild symbol instances involved in the win are updated to include a wild symbol. In some cases only one non-wild symbol may be updated (e.g., where the win involved all but one wild symbol) and in other cases a plurality of non-wild symbols may be updated.

The virtual reels are, therefore, updated to replace a non-wild symbol with a wild symbol. The new wild symbol may be referred to as a spawned wild symbol (as distinguished from the original wild symbol described above). That is, a spawned wild symbol is one which was provided on the reel after a prior iteration of the bonus game based on the results of the prior iteration of the bonus game.

A spawned wild symbol may, in at least some embodiments, have the same function as an original wild symbol. For example, the spawned wild may assume the identity of other symbols for the purpose of determining whether a win has occurred. Furthermore, in at least some embodiments, during subsequent iterations of the bonus game, a spawned wild symbol may spawn additional spawned wild symbols. That is, when a spawned wild symbol is involved in a win, the other non-wild symbol(s) involved in the win may be updated to also become spawned wild symbols.

However, in at least some embodiments, the appearance of a spawned wild symbol may be different than an original wild symbol. For example, in at least some embodiments, a wild symbol 514 may be displayed as an overlay on an underlying symbol that previously occupied the same symbol location. That is, when a non-wild symbol is changed to a wild symbol, the wild symbol may be applied as an overlay on top of the non-wild symbol so that the non-wild symbol remains visible. This allows a player to track the underlying symbols that have spawned to ensure that the game remains fair and is operating as they expect it to.

The new wild symbol's (i.e. the spawned wild's) position in the first gaming zone of the display is not static but rather it is moved along with the virtual reel that it occupies so that it is moved out of the specific symbol location that it occupies during a next iteration of the game (at which point it may land in the same symbol location, another symbol location on the same reel, or off-screen).

Accordingly, at operation 418, the display 12 of the EGM 10 and memory associated with the EGM 10 may be updated to reflect the inclusion of a new wild symbol in the virtual reels.

Figure 7:
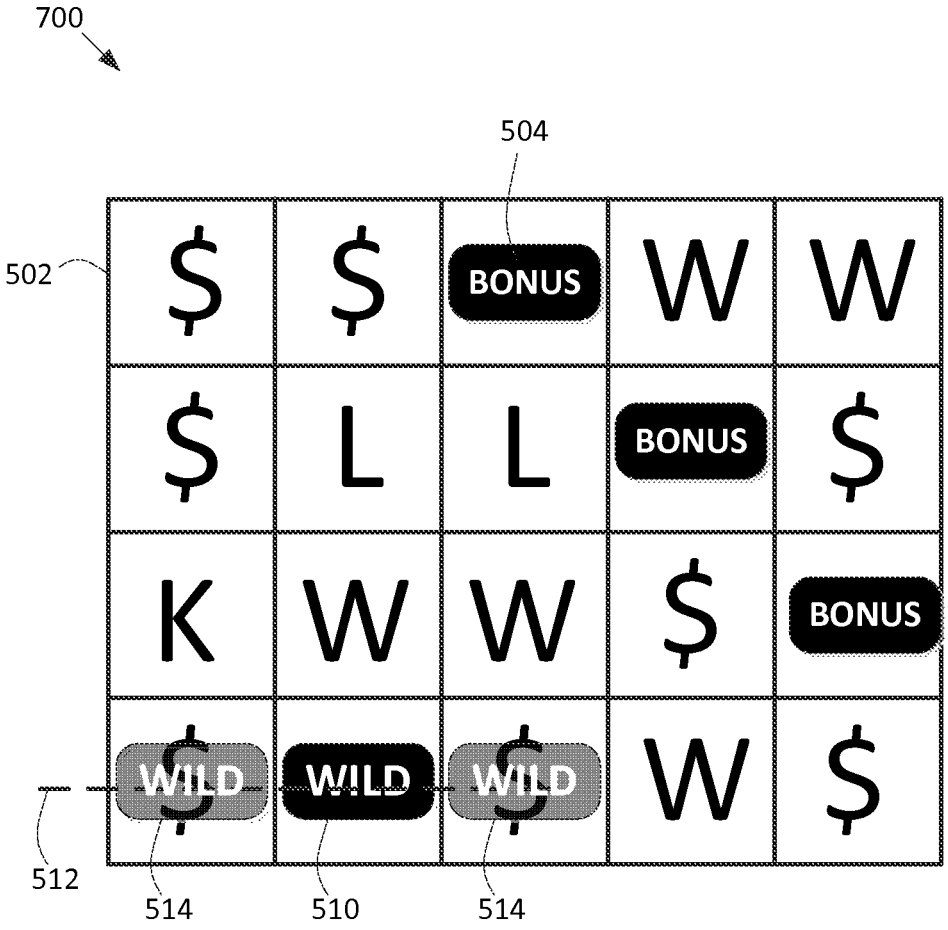
FIG. 7 is another example display screen representing the first gaming zone after a wild symbol has been spawned.

Referring briefly to FIG. 7, an example of a display screen 700 which in which wilds have been spawned is illustrated. The display screen 700 of FIG. 7 may be displayed after the display screen 600 of FIG. 6. The display screen 700 of FIG. 7 includes two new spawned wilds located at the locations along the payline 512 where the winning combination was found.

Referring again to FIG. 4, if the outcome of the iteration of the bonus game performed at operation 408 is not a win (as determined at operation 412) or if the outcome is a win and the wilds have then been spawned (at operation 418) or not spawned (based on the determination at operation 416), then the EGM 10 may determine whether a further iteration of the bonus game is permitted (at operation 420). If further iterations of the bonus game are permitted, then an additional iteration of the bonus game may be performed by resuming play at operation 408. During this subsequent iteration of the game, the spawned wilds 514 and original wilds 510 are both included. In at least some embodiments, the spawned wilds 514 may remain for all subsequent iterations of the bonus game until play is returned to the main game. Thus, as play in the bonus game progresses (i.e. as more iterations are played), the number of wilds may rapidly expand. Thus, the odds of a winning combination occurring does not remain static throughout the game; the odds get progressively better as the number of wild symbols increases.

If no further iterations of the bonus game are permitted then the bonus game may be terminated and operation of the main game may resume.

In at least some embodiments, when resuming operation of the main game, all instances of spawned wild symbols are returned to the state that they were in before they became spawned wild symbols. That is, when no further iterations of the bonus game are permitted, then the EGM 10 resets, at operation 422, one or more of the symbol instances representing a spawned wild symbol to the symbol that occupied the same position of the reel before that symbol instance was updated to include the spawned wild symbol. As noted above, in some embodiments, spawned wild symbols are overlaid upon underlying symbols and, in such embodiments, the overlaid spawned wild symbol may be removed to display only the underlying symbol.

The determination of whether the player is permitted to play more bonus games at operation 420 may be made based on predetermined trigger condition. For example, when the trigger condition is detected, the EGM 10 may determine that no further instances of the bonus game are permitted. For example, as noted above, in some embodiments, a player is awarded a certain number of iterations of the bonus game and, when those iterations are exhausted, play resumes with the main game. In such embodiments the trigger condition may be said to occur when the count of the iterations of the bonus game played reaches a threshold. That is, when all iterations of the bonus game provided in the bonus portion of the game have been played, then the trigger condition may be said to have occurred.

It will be appreciated that, in at least some embodiments, for processing efficiency, operation 420 may be performed prior to operations 416 and 418.

While the EGM 10 that performs the method may, in some embodiments, be an EGM 10 of the type described above with reference to FIG. 1, in other embodiments the EGM 10 may take other forms. Accordingly, the methods and features described herein may be applied to other systems apart from the EGM 10. For example, the game may be played on a standalone video gaming machine, a gaming console, on a general purpose computer connected to the Internet, on a smart phone, or using any other type of gaming device. The video gaming system may include multiplayer gaming features.

The above-described embodiments can be implemented in any of numerous ways. For example, the embodiments may be implemented using hardware, software or a combination thereof. When implemented in software, the software code can be executed on any suitable processor or collection of processors, whether provided in a single computer or distributed among multiple computers. Such processors may be implemented as integrated circuits, with one or more processors in an integrated circuit component. A processor may be implemented using circuitry in any suitable format.

The improvements described herein may be included in any one of a number of possible gaming systems including, for example, a computer, a mobile device such as a smart phone or tablet computer, a casino-based gaming terminal, a wearable device such as a virtual reality (VR) or augmented reality (AR) headset, or gaming devices of other types. In at least some embodiments, the gaming system may be connected to the Internet via a communication path such as a Local Area Network (LAN) and/or a Wide Area Network (WAN). In at least some embodiments, the gaming improvements described herein may be included in an Electronic Gaming Machine (EGM).

The embodiments described herein are implemented by physical computer hardware embodiments. The embodiments described herein provide useful physical machines and particularly configured computer hardware arrangements of computing devices, servers, electronic gaming terminals, processors, memory, networks, for example. The embodiments described herein, for example, is directed to computer apparatuses, and methods implemented by computers through the processing of electronic data signals.

The embodiments described herein involve numerous hardware components such computing devices, processors, memory, display. These components and combinations thereof may be configured to perform the various functions described herein. Accordingly, the embodiments described herein are directed towards electronic machines that are configured to process and transform electromagnetic signals representing various types of information. The embodiments described herein pervasively and integrally relate to machines, and their uses; and the embodiments described herein have no meaning or practical applicability outside their use with computer hardware, machines, a various hardware components.

Substituting the EGM 10, computing devices, processors, memory, and/or display, for non-physical hardware, using mental steps for example, substantially affects the way the embodiments work.

At least some computer hardware features are clearly essential elements of the embodiments described herein, and they cannot be omitted or substituted for mental means without having a material effect on the operation and structure of the embodiments described herein. The computer hardware is essential to the embodiments described herein and is not merely used to perform steps expeditiously and in an efficient manner.

Further, it should be appreciated that a computer may be embodied in any of a number of forms, such as a rack-mounted computer, a desktop computer, a laptop computer, or a tablet computer. Additionally, a computer may be embedded in a device not generally regarded as a computer but with suitable processing capabilities, including an EGM, A Web TV, a Personal Digital Assistant (PDA), a smart phone, a tablet or any other suitable portable or fixed electronic device.

Also, a computer may have one or more input and output devices. These devices can be used, among other things, to present a user interface. Examples of output devices that can be used to provide a user interface include printers or display screens for visual presentation of output and speakers or other sound generating devices for audible presentation of output. Examples of input mechanisms that can be used for a user interface include keyboards and pointing devices, such as mice, touch pads, and digitizing tablets. As another example, a computer may receive input information through speech recognition or in other audible formats.

Such computers may be interconnected by one or more networks in any suitable form, including as a local area network or a wide area network, such as an enterprise network or the Internet. Such networks may be based on any suitable technology and may operate according to any suitable protocol and may include wireless networks, wired networks or fiber optic networks.

The various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, the enhancements to game components may be embodied as a tangible, non-transitory computer readable storage medium (or multiple computer readable storage media) (e.g., a computer memory, one or more floppy discs, compact discs (CD), optical discs, digital video disks (DVD), magnetic tapes, flash memories, circuit configurations in Field Programmable Gate Arrays or other semiconductor devices, or other non-transitory, tangible computer-readable storage media) encoded with one or more programs that, when executed on one or more computers or other processors, perform methods that implement the various embodiments discussed above. The computer readable medium or media can be transportable, such that the program or programs stored thereon can be loaded onto one or more different computers or other processors to implement various aspects as discussed above. As used herein, the term "non-transitory computer-readable storage medium" encompasses only a computer-readable medium that can be considered to be a manufacture (i.e., article of manufacture) or a machine.

The terms "program" or "software" are used herein in a generic sense to refer to any type of computer code or set of computer-executable instructions that can be employed to program a computer or other processor to implement various aspects of the present invention as discussed above. Additionally, it should be appreciated that according to one aspect of this embodiment, one or more computer programs that when executed perform methods as described herein need not reside on a single computer or processor, but may be distributed in a modular fashion amongst a number of different computers or processors to implement various aspects.

Computer-executable instructions may be in many forms, such as program modules, executed by one or more computers or other devices. Generally, program modules include routines, programs, objects, components, data structures, etc, that perform particular tasks or implement particular abstract data types. Typically the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that conveys relationship between the fields. However, any suitable mechanism may be used to establish a relationship between information in fields of a data structure, including through the use of pointers, tags or other mechanisms that establish relationship between data elements.

Various aspects of the present game enhancements may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments. While particular embodiments have been shown and described, it will be obvious to those skilled in the art that changes and modifications may be made without departing from this invention in its broader aspects. The appended claims are to encompass within their scope all such changes and modifications.

What is claimed is:

1. A gaming system providing a game, the gaming system comprising:

an input mechanism for initiating the game;

one or more displays providing a plurality of reels, the plurality of reels provided in a first gaming zone of the one or more displays, the first gaming zone comprising a matrix of symbol locations which are updated to provide results of the game by showing symbol instances; and a controller coupled to the one or more displays and the input mechanism, the controller configured to:

detect a win involving a combination of the symbol instances across two or more of the plurality of reels;

determine that at least one of the symbol instances involved in the win is a first wild symbol, the wild symbol able to assume an identity of at least one other symbol when detecting the win;

in response to determining that at least one of the symbol instances involved in the win is the first wild symbol, update at least one of the other of the symbol instances involved in the win to include a second wild symbol for at least a next iteration of the game, wherein, after updating at least one of the other of the symbol instances involved in the win to include the second wild symbol, the controller is further configured to:

detect a win involving a combination of the symbol instances, at least one of the symbol instances being the second wild symbol involved in the updating; and in response to detecting the win, to update at least one of the other of the symbol instances involved in the win to include a third wild symbol for a future iteration of the game.

2. The gaming system of claim 1, wherein updating at least one of the other of the symbol instances involved in the win comprises updating all non-wild symbol instances involved in the win.

3. The gaming system of claim 1, wherein in the controller is further configured to: detect a trigger condition and, in response, reset one or more of the symbol instances representing the first wild symbol or the second wild symbol to a symbol that occupied the same position of the reel before that symbol instance was updated to include the first wild symbol or the second wild symbol.

4. The gaming system of claim 3, wherein in the controller is further configured to: count the number of iterations of the game played, and wherein the trigger condition occurs when the count of the iterations of the game played reaches a threshold.

5. The gaming system of claim 4, wherein the win is detected within a bonus portion of a game, the bonus portion of the game permitting a player to play a specific number of iterations of the game, and wherein the trigger condition occurs when all iterations of the game provided in the bonus portion have been played.

6. The gaming system of claim 5, wherein the specific number of iterations of the bonus game is determined in accordance with one or more predetermined rules, the predetermined rules based on outcome of game play in a main game.

7. The gaming system of claim 1, wherein updating the at least one of the symbol instances includes displaying the first wild symbol and/or the second wild symbol as an overlay on an underlying symbol such that the underlying symbol is partially visible.

8. The gaming system of claim 1, wherein updating at least one of the other of the symbol instances involved in the win to include the second wild symbol for at least the next iteration of the game comprises updating at least two of the other symbol instances involved in the win.

9. The gaming system of claim 1, wherein the first wild symbol involved in the win is an original wild symbol which was initiated before a first iteration of the game.

10. The gaming system of claim 1, wherein the second wild symbol involved in the win is a spawned wild symbol which was provided on the reel after a prior iteration of the game based on the results of the prior iteration of the game.

11. A method performed by a gaming system, the method comprising:

detecting a win involving a combination of symbol instances across two or more of reels;

determining that at least one of the symbol instances involved in the win is a first wild symbol, the wild symbol able to assume an identity of at least one other symbol when detecting the win; and in response to determining that at least one of the symbol instances involved in the win is the first wild symbol, updating at least one of the other of the symbol instances involved in the win to include a second wild symbol for at least a next iteration of the game, wherein, after updating at least one of the other of the symbol instances involved in the win to include the second wild symbol, the controller is further configured to:

detect a win involving a combination of the symbol instances, at least one of the symbol instances being the second wild symbol involved in the updating; and in response to detecting the win, to update at least one of the other of the symbol instances involved in the win to include a third wild symbol for a future iteration of the game.

12. The method of claim 11, wherein updating at least one of the other of the symbol instances involved in the win comprises updating all non-wild symbol instances involved in the win.

13. The method of claim 11, further comprising: detecting a trigger condition and, in response, resetting one or more of the symbol instances representing the wild symbol to a symbol that occupied the same position of the reel before that symbol instance was updated to include the wild symbol.

14. The method of claim 13, further comprising: counting the number of iterations of the game played; and wherein the trigger condition occurs when the count of the iterations of the game played reaches a threshold.

15. The method of claim 14, wherein the win is detected within a bonus portion of a game, the bonus portion of the game permitting a player to play a specific number of iterations of the game, and wherein the trigger condition occurs when all iterations of the game provided in the bonus portion have been played.

16. The method of claim 15, wherein the specific number of iterations of the bonus game is determined in accordance with one or more predetermined rules, the predetermined rules based on outcome of game play in a main game.

17. The method of claim 11, wherein updating the at least one of the symbol instances includes displaying the first wild symbol and/or the second wild symbol as an overlay on an underlying symbol such that the underlying symbol is partially visible.

18. The method of claim 11, further comprising: after updating at least one of the other of the symbol instances involved in the win to include the second wild symbol:

detecting a win involving a combination of the symbol instances, at least one of the symbol instances being the symbol instance involved in the updating; and in response to detecting the win, updating at least one of the other of the symbol instances involved in the win to include a third wild symbol for a next iteration of the game.

19. The method of claim 11, wherein updating at least one of the other of the symbol instances involved in the win to include the wild symbol for at least the next iteration of the game comprises updating at least two of the other symbol instances involved in the win.

20. The method of claim 11, further comprising: detecting a trigger condition and, in response, resetting one or more of the symbol instances representing the wild symbol to a symbol that occupied the same position of the reel before that symbol instance was updated to include the wild symbol; and counting the number of iterations of the game played, wherein the first wild symbol and the second wild symbol remain for subsequent iterations until a count of the iterations reaches a threshold.

* * * * *